US007096690B2

(12) United States Patent
James

(10) Patent No.: US 7,096,690 B2
(45) Date of Patent: Aug. 29, 2006

(54) BRACELET AND PENDANT

(76) Inventor: Tommy J James, 1806 Bailey Ave., Wilmington, NC (US) 28411

( * ) Notice: Subject to any disclaimer, the term of this patent is extended or adjusted under 35 U.S.C. 154(b) by 48 days.

(21) Appl. No.: 10/465,504

(22) Filed: Jun. 19, 2003

(65) Prior Publication Data

US 2004/0255619 A1 Dec. 23, 2004

(51) Int. Cl.
*A44C 5/00* (2006.01)

(52) U.S. Cl. ..... 63/3.1; 63/40

(58) Field of Classification Search ..... 63/5.1, 63/13, 3.1, 11, 20, 23, 35, 3, 1.16, 1.17, 18, 63/19, 15.1–15.4, 40; D11/1–7
See application file for complete search history.

(56) References Cited

U.S. PATENT DOCUMENTS

| | | | | | |
|---|---|---|---|---|---|
| 275,584 | A | * | 4/1883 | Cahn | 63/20 |
| 290,590 | A | * | 12/1883 | Lettre | 63/9 |
| 883,375 | A | * | 3/1908 | Anello | 24/6 |
| 1,398,803 | A | * | 11/1921 | Schneider | 24/13 |
| 1,624,458 | A | * | 4/1927 | Zook | 40/1.5 |
| 1,756,041 | A | * | 4/1930 | Vance, Sr. | 63/3 |
| 2,003,950 | A | * | 6/1935 | Pejchar | 63/27 |
| 2,324,430 | A | * | 7/1943 | Schalet et al. | 24/359 |
| 2,357,782 | A | * | 9/1944 | Rubin | 63/20 |
| 2,624,092 | A | * | 1/1953 | Duerr | 24/598.5 |
| 3,192,737 | A | | 7/1965 | Schechter et al. | |
| 3,208,238 | A | * | 9/1965 | Spitzer | 63/3.1 |
| 3,481,155 | A | | 12/1969 | Cook | |
| 3,686,894 | A | * | 8/1972 | Handler et al. | 63/19 |
| 3,850,010 | A | * | 11/1974 | Noto | 63/1.16 |
| 4,024,585 | A | * | 5/1977 | Girdler | 2/153 |
| 4,059,853 | A | * | 11/1977 | Girdler | 24/66.4 |
| 4,276,757 | A | * | 7/1981 | Boening | 63/1.11 |
| 4,377,939 | A | | 3/1983 | Reinsdorf | |
| 4,562,619 | A | | 1/1986 | Plaza | |
| 4,665,595 | A | | 5/1987 | Viot et al. | |
| 4,726,200 | A | | 2/1988 | Carter | |
| 4,763,489 | A | | 8/1988 | Strong | |
| 4,974,429 | A | | 12/1990 | Ferrara | |
| 5,031,420 | A | * | 7/1991 | Song | 63/21 |
| 5,048,311 | A | * | 9/1991 | Mastrobuono | 63/12 |
| 5,052,195 | A | * | 10/1991 | Lunt | 63/21 |
| 5,245,844 | A | * | 9/1993 | Panzer | 63/1.16 |
| 5,369,854 | A | * | 12/1994 | Stephens | 24/587.11 |
| 5,438,850 | A | * | 8/1995 | Keating et al. | 63/20 |
| 5,440,900 | A | * | 8/1995 | White | 63/38 |
| 5,713,080 | A | * | 2/1998 | Tate | 2/80 |
| 5,722,260 | A | * | 3/1998 | Mangano | 63/3.1 |
| 5,921,110 | A | | 7/1999 | Middendorff et al. | |
| 6,138,356 | A | * | 10/2000 | Hertelendy | 29/896.41 |
| 6,263,702 | B1 | * | 7/2001 | Lo | 63/1.11 |

(Continued)

*Primary Examiner*—Jack W. Lavinder
(74) *Attorney, Agent, or Firm*—MacCord Mason PLLC

(57) ABSTRACT

A bracelet has a removable ornament that can also be worn as a necklace pendant. The bracelet includes a resilient wristband with opposed first and second ends with hooks at each end. The hooks are preferably transverse to the plane of the wristband and extend in opposite directions. The ornament has a bottom surface that includes a first loop adapted to receive the wristband hooks for releasable attachment of the ornament to the wristband, and a second loop to receive a necklace. The first loop preferably includes a central section substantially parallel to the ornament bottom surface and end sections connecting the central section to the ornament bottom surface. The second loop is preferably transverse to the first loop and lies along an axis substantially equidistant between the end sections of the first loop.

13 Claims, 2 Drawing Sheets

U.S. PATENT DOCUMENTS 6,293,128 B1 * 9/2001 Leufray-Simms ..... 63/23
6,381,985 B1 5/2002 Burgard
6,422,036 B1 * 7/2002 Giannis et al. ..... 63/3.1
6,427,487 B1 * 8/2002 Morgan ..... 63/29.1
6,557,377 B1 * 5/2003 Massari ..... 63/23
6,711,915 B1 * 3/2004 Quach ..... 63/31
6,742,359 B1 * 6/2004 Takessian ..... 63/29.1
2003/0106336 A1 * 6/2003 Gaskill ..... 63/3

* cited by examiner

BRACELET AND PENDANT

BACKGROUND OF THE INVENTION (1) Field of the Invention

The present invention relates to a combination bracelet and pendant, and in particular to a bracelet comprised of a wristband and removable ornament that can be used as a pendant.

(2) Description of the Prior Art

Combination bracelets with removable ornaments that can be used as a pendant are known in the prior art. Basically, such bracelets are comprised of a wristband with opposed ends that are adapted for releasable attachment to an ornament that includes a first means enabling attachment of the ornament to the ends of the wristband, and a second means enabling attachment of the ornament to a necklace, e.g., a chain or cord, to be worn about the user's neck, so that the ornament can serve as a pendant.

One combination bracelet and ornament is shown in U.S. Pat. No. 4,974,429 to Ferrara. The Ferrara bracelet is comprised of a resilient, oval-shaped wristband sized to encircle a user's wrist. The wristband has a rectangular opening in either end. The ornament has a lower or bottom surface that includes inwardly directed hooks on opposite sides of the ornament, with the hooks being sized for insertion into the openings in the end of the wristband. The lower surface of the ornament also includes a small loop adapted to receive a necklace so that the ornament can be worn as a pendant.

The bracelet is worn by placing the wristband about the user's wrist and compressing the resilient band to bring the ends of the wristband toward each other. One ornament hook is inserted into one wristband opening, and the other hook is inserted into the other wristband opening. When no longer compressed, the wristband flexes outwardly, holding the ornament in place on the wristband, so that the combination of wristband and ornament can be worn as a bracelet.

When the user desires to wear the ornament as a pendant, the ends of the wristband are compressed, and the hooks are detached from the openings in the wristband. The pendant is then removed, and a necklace is inserted through the small loop on the lower surface of the ornament, permitting the ornament to be worn as a pendant on the necklace.

While the Ferrara combination bracelet and pendant is useful in permitting the ornament, which can be the major cost of the bracelet, to also be used as a pendant, further improvements are needed. In particular, an improved means is needed to releasibly attach an ornament to a wristband, enabling the ornament to be more easily attached in a manner that will securely hold the ornament in place during use.

SUMMARY OF THE INVENTION

Generally, the bracelet of the invention is comprised of a wristband that has opposite ends, with a hook at either end of the wristband, and an ornament that can be detachably secured to the hooks. The hooks are preferably transverse to the plane of the wristband, and extend in opposite directions. The ornament has an upper or top decorative surface, and a lower or bottom surface that includes a first loop adapted to receive the wristband hooks. Preferably, the first loop is flattened and substantially parallel to the bottom surface of the ornament so that the bracelet can be worn comfortably.

A second loop is also attached to the ornament, preferably on the ornament bottom surface, so that the ornament can also be used as a pendant on a necklace. The second loop opening is of a size sufficient to permit insertion of a necklace, e.g., a chain or cord, through the second loop. The second loop can be independent of the first loop, or one end of the second loop can be integral with or attached to the first loop. Alternatively, the second loop can have a proximal end that is attached by a hinge to an edge of the ornament, so that the second loop is moveable between a closed position parallel to the bottom surface of the ornament and an open position in which the second loop extends outwardly from the ornament body. The second loop may also include a distal end that includes a detent or groove, with the distal end being adapted to engage the first loop and releasibly lock the second loop in the closed position.

The decorative upper surface of the ornament can be of various aesthetically pleasing configurations, such as animals, artistic designs, etc. If desired, a stone or jewel can be fitted into the upper surface of the ornament. Preferably the second loop is positioned adjacent an edge of the bottom surface of the ornament. If the ornament is in the configuration of an animal with a head, the second loop may be placed beneath the animal's head, so that the ornament will be in an upright orientation when worn as a pendant.

The bracelet may be secured around the user's wrist by inserting the wristband around the wrist and compressing the band to move the hooks closer to each other. The hooks are then inserted through the first loop, and the compression on the band is released to hold the ornament in place. The band can again be compressed to remove the ornament, which can then be worn as a pendant on a chain.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
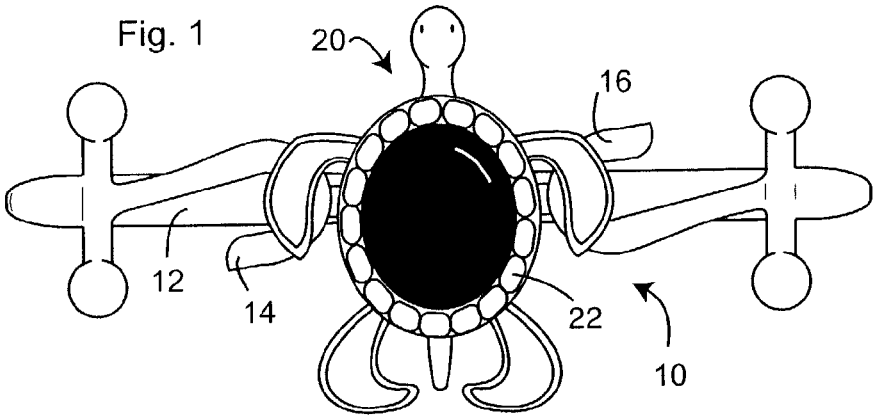
FIG. 1 is a top view of a preferred embodiment of the bracelet with a removable ornament.
Figure 2:
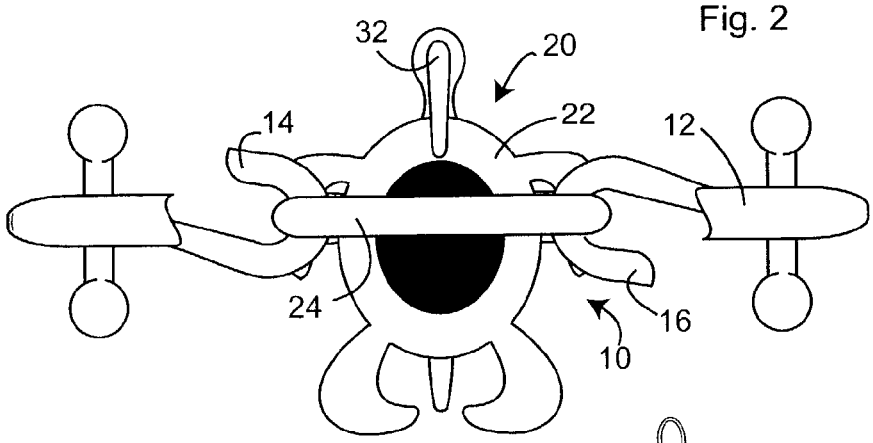
FIG. 2 is sectional bottom view of the bracelet of FIG. 1 with a portion of the wristband cut away for clarity.
Figure 3:
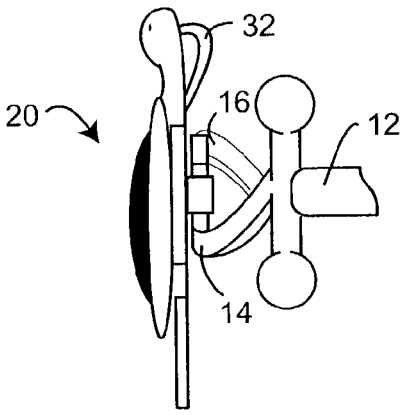
FIG. 3 is a side view of the bracelet of FIG. 1.
Figure 4:
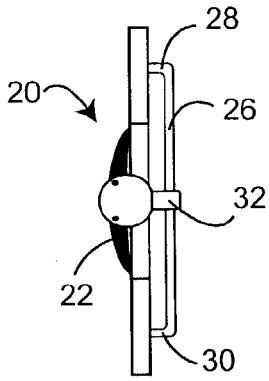
FIG. 4 is an end view of the ornament of the bracelet of FIG. 1.

As illustrated in FIGS. 1–3, bracelet, generally 10, is comprised of a resilient wristband 12 sized to encircle a user's wrist, a first hook 14 attached to one end of band 12 and a second hook 16 attached to the opposite end of band 12. Hooks 14 and 16 are transverse to the plane of band 12 and extend in opposite directions. Each of hooks 14 and 16 preferably extends about a curvature of at least 180° to releasibly secure ornament, generally 20, in place.

As illustrated, ornament 20 is a sea turtle. It will be appreciated, however, that the ornamental features of ornament 20 can be of any shape and design desired, and that the sea turtle is merely representative. As best seen in FIG. 2, in which a part of band 12 is cut away to facilitate viewing of the bottom surface of ornament 20, ornament 20 includes an ornament body 22, a first loop 24 extending across the bottom surface of ornament 20 between opposed edges of ornament body 22 for use in attaching hooks 14 and 16. First loop 24 includes a generally flattened or planar central section 26 that is substantially parallel to the bottom surface of ornament body 22, so that bracelet 10 can be worn comfortably, and end sections 28 and 30 joining central section 26 to the bottom surface of ornament body 22.

Figure 5:
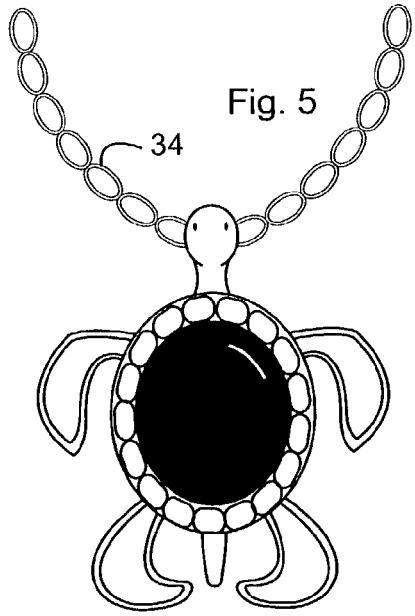
FIG. 5 is a front view of the ornament from the bracelet of FIG. 1 used as a pendant on a necklace.

Ornament 20 also includes a small second loop 32 adapted to attach ornament 20 to a necklace chain 34, as shown in FIG. 5. Second loop 32 is preferably positioned adjacent an edge of the bottom surface of ornament body 22. Preferably, loop 32 is transverse to loop 24, and lies along an axis approximately equidistant between end sections 28 and 30 of loop 24. As shown in the embodiment illustrated, loop 32 is positioned beneath the head portion of the sea turtle, so that the sea turtle is worn in an upright position on chain 34.

When worn, band 12 is inserted around the user's wrist, and is compressed to move hooks 12 and 14 toward each other. Hooks 12 and 14 are inserted through first loop 24, and the compression on band 12 is released, moving hooks 12 and 14 away from each other due to the resilience of band 12, thereby securely holding ornament 20 onto band 12. When desired, band 12 can again be compressed to remove ornament 20. Chain 34, or another necklace, can then be inserted through loop 32 so that ornament 20 can be worn as a pendant.

It has been found that the present construction has several advantages over prior art combination bracelet and pendant constructions, e.g., the bracelet and pendant illustrated in the above Ferrara patent. The bracelet can be easily attached around the user's wrist and removed, whether the bracelet is worn on the right or left wrist. The ornament is held securely in place, even if the band is accidentally compressed while being worn, and the bracelet can be flexed at the junctures of the ornament and band without risking detachment of the ornament, thus promoting increased comfort.

Figure 6:
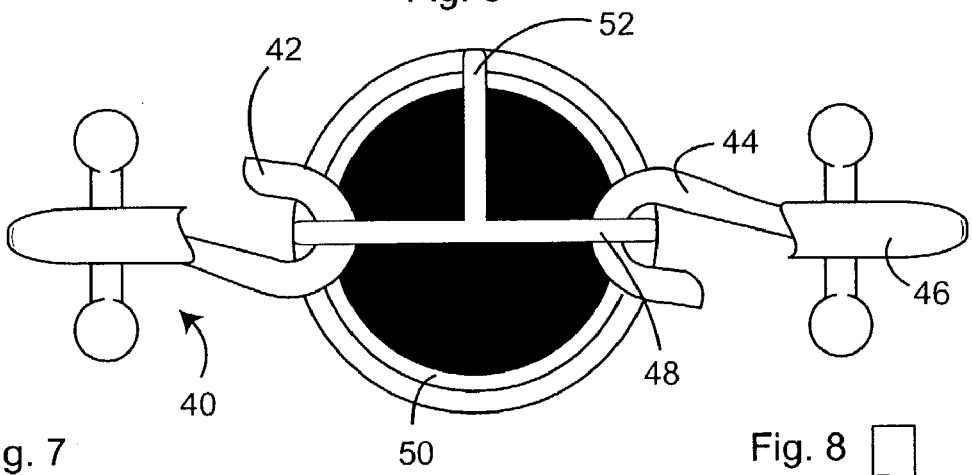
FIG. 6 is a sectional bottom view of another bracelet with a portion of the wristband cut away for clarity, showing an ornament in which the two loops are joined.
Figure 7:
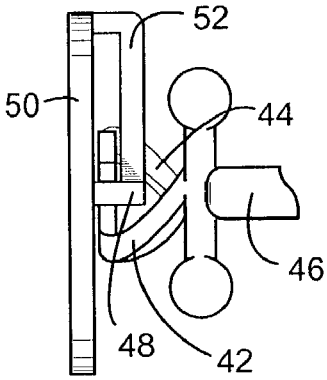
FIG. 7 is a side view of the bracelet of FIG. 6.

In the alternative embodiment illustrated in FIGS. 6 and 7, bracelet, generally 38, includes ornament, generally 40, attached to hooks 42 and 44 of wristband, generally 46, by a first loop 48 extending across the bottom surface of ornament body 50. First loop 48 includes a generally flattened or planar central section that is substantially parallel to the bottom surface of ornament body 50. A second loop 52 adapted to attach ornament 40 to a necklace is preferably transverse to loop 48, and includes a first end attached to an edge of ornament body 50 and a second end attached to loop 48 approximately equidistant between the ends of loop 48.

Figure 8:
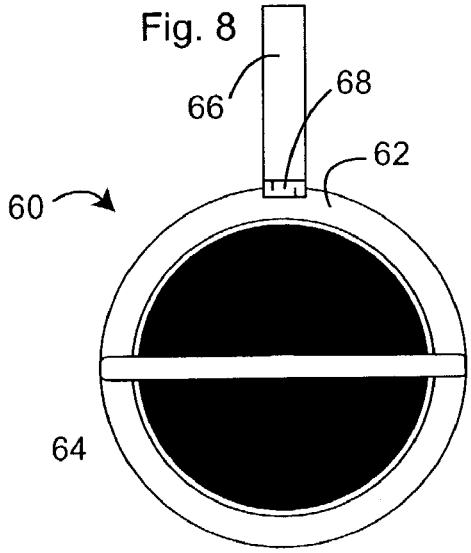
FIG. 8 is a back view of another ornament suitable for use with the wristbands of FIG. 1 or 6, in which the loop used to attach the ornament of a necklace is hinged.
Figure 9:
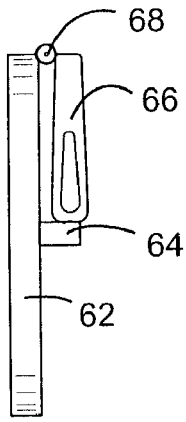
FIG. 9 is a side view of the ornament of FIG. 8 with the necklace attachment loop in the closed position.
Figure 10:
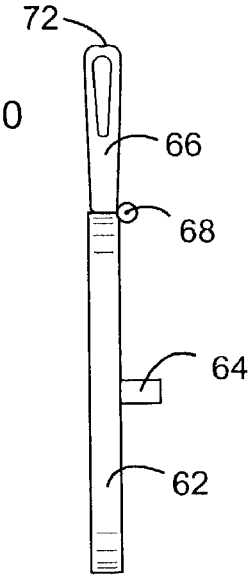
FIG. 10 is a side view of the ornament of FIG. 8 with the necklace attachment loop in the open position.

FIGS. 8–10 illustrate another ornament, generally 60, that includes an ornament body 62, a first loop 64 used to attach ornament 60 to hooks of a wristband of the type illustrated in the preceding embodiments. Ornament 60 also includes a second or necklace attachment loop 66 joined adjacent an edge of ornament body 62 with hinge 68. Loop 66 is rotatable on hinge 68 between a closed position as shown in FIG. 9 and an open position as shown in FIGS. 8 and 10. A detent 70 on the distal end of loop 66 engages loop 64 when loop 66 is in the closed position to releasable secure loop 66 in the closed position. Loop 66 is secured in the closed position when worn on a bracelet, and in the open position when worn on a necklace, which extends through opening 72 in loop 66.

Certain modifications and improvements will occur to those skilled in the art upon a reading of the foregoing description. For example, the second loop on the ornament can be eliminated with the wristband and ornament being simply worn as a bracelet. It should be understood that all such modifications and improvements have been deleted herein for the sake of conciseness and readability but are properly within the scope of the following claims.

What is claimed is:

1. A bracelet with a removable ornament comprising:

a) a resilient wristband having opposed first and second ends with a hook at each end, said hooks being transverse to the plane of said wristband and extending about a curvature of at least 180° with openings facing in opposite directions; and b) an ornament having a bottom surface, and a first closed loop extending across said bottom surface adapted to receive the wristband hooks for releasable attachment of the ornament to the wristband, said loop including a central portion substantially parallel to said ornament bottom surface, and end portions connecting said central portion to said bottom surface, said hooks being insertable around said end portions to secure said ornament to said bracelet.

2. The bracelet of claim 1, wherein said ornament further includes a second loop to receive a necklace, said second loop being transverse to said first loop.

3. The bracelet of claim 2, wherein said second loop has an end attached to said first loop.

4. The bracelet of claim 2, wherein said second loop includes a proximal end hinged to said ornament.

5. A bracelet with a removable ornament useful as a necklace pendant comprising:

a) a resilient wristband having opposed first and second ends with a hook at each end, said hooks being transverse to the plane of said wristband and extending about a curvature of at least 180° with openings facing in opposite directions; and b) an ornament having a bottom surface including a first closed loop extending across said bottom surface adapted to receive the wristband hooks for releasable attachment of the ornament to the wristband, and a second loop transverse to said first loop to receive a necklace, said first loop including a central portion substantially parallel to said ornament bottom surface and end portions connecting said central portion to said bottom surface, said hooks being insertable around said end portions to secure said ornament to said bracelet.

6. The bracelet of claim 5, wherein said second loop is positioned near an edge of said ornament.

7. The bracelet of claim 5, wherein said second loop has an end attached to said first loop.

8. The bracelet of claim 5, wherein said second loop includes a proximal end hinged to said ornament.

9. A jewelry system comprising:

a) a resilient wristband having opposed first and second ends with a hook at each end, said hooks being transverse to the plane of said wristband and extending about a curvature of at least 180° with openings facing in opposite directions;

b) an ornament having a bottom surface, a first closed loop extending across said bottom surface adapted to receive the wristband hooks for releasable attachment of the ornament to the wristband, and a second loop transverse to said first loop to receive a necklace, said first loop including a central portion substantially parallel to said ornament bottom surface and end portions connecting said central portion to said bottom surface, said hooks being insertable around said end portions to secure said ornament to said bracelet; and c) a necklace insertable through said second loop.

10. A bracelet with a removable ornament useful as a necklace pendant comprising:

a) a resilient wristband having opposed first and second ends with a hook at each end, said hooks being transverse to the plane of said wristband and having openings extending in opposite directions; and b) an ornament having opposed edges and a bottom surface, said ornament including a first loop with a central portion substantially parallel to said ornament bottom surface and end portions connecting said central portion to said bottom surface extending across said bottom surface and adapted to receive the wristband hooks for releasable attachment of the ornament to the wristband, and a second loop to receive a necklace, said second loop being transverse to said first loop, said second loop is moveable between an open position and a closed position, said second loop including a distal end with a detent, said distal end being adapted to engage said first loop to releasibly lock said second loop in said closed position.

11. The bracelet of claim 10, wherein said second loop has an end attached to said first loop.

12. The bracelet of claim 10, wherein said second loop includes a proximal end hinged adjacent an edge of said ornament, said second loop being moveable between a closed position and an open position.

13. The bracelet of claim 12, wherein said second loop has a distal end engaging said first loop when said second loop is in the closed position.

* * * * *